US005632470A

United States Patent [19]

Leland

[11] Patent Number: 5,632,470

[45] Date of Patent: May 27, 1997

[54] WIRE FENCING APPARATUS

[76] Inventor: Leonard Leland, Box 112, Ismay, Mont. 59336

[21] Appl. No.: 525,983

[22] Filed: Sep. 11, 1995

[51] Int. Cl.[6] ..... B66F 1/00

[52] U.S. Cl. ..... 254/385; 254/228; 254/323; 242/557

[58] Field of Search ..... 254/228, 323, 254/385, 386; 242/557

[56] References Cited

U.S. PATENT DOCUMENTS

| | | | |
|---|---|---|---|
| 1,353,304 | 9/1920 | Ahlstrom | 242/557 X |
| 3,201,085 | 8/1965 | Maley . | |
| 3,519,246 | 7/1970 | Belding . | |
| 3,627,266 | 12/1971 | Braun . | |
| 4,917,566 | 4/1990 | Chauvin | 254/386 X |
| 5,042,737 | 8/1991 | Sigle et al. | 242/557 X |
| 5,316,232 | 5/1994 | Lambert, Jr. | 242/557 X |
| 5,476,234 | 12/1995 | St. Pierre | 242/557 |

*Primary Examiner*—Daniel P. Stodola
*Assistant Examiner*—Emmanuel M. Marcelo

[57] ABSTRACT

A wire fencing tensioning apparatus comprising a generally rectangular shaped open frame carriage mounted on a standard three-way hitch on the rear of a tractor. The generally rectangular shaped open frame carriage comprises a plurality of corresponding parallel members joined at ends to form corners, which members and corners define the generally rectangular shaped open frame carriage. The wire fencing tensioning apparatus has a pair of extending hydraulic cylinders. Each of the extending hydraulic cylinders has a pulley attached to the top of the extending portion or piston thereof through each of which pulley a cable is strung. The wire fencing tensioning apparatus has a hydraulic control, the hydraulic control being capable of independently controlling each of extending hydraulic cylinders. The wire fencing tensioning apparatus has a pair of pulley-cable systems by which tension is supplied to "stretch" the wire. The pair of pulley-cable systems provide one pulley-cable system each on each of the pair of extending hydraulic cylinders. The pair of pulley-cable systems provide for tensioning two separate strands of fence wire from opposite directions as well as tensioning single strands from either direction of the wire fencing tensioning apparatus.

1 Claim, 3 Drawing Sheets

WIRE FENCING APPARATUS

The present invention relates to a wire fencing tensioning apparatus, and more particularly to an apparatus for stringing and tensioning wire to a uniform, consistent, measured degree for attachment to fencing poles.

BACKGROUND OF THE INVENTION

When erecting fences, particularly multiple strand wire fences, there is a need for a simple, inexpensive and easily used apparatus which conveniently strings the wire strands over the terrain upon which the fence is to be erected as well as which tensions the wire strands to a uniform, consistent, measured degree for attachment to fencing poles. For purposes of safety to the person erecting the fence as well as the optimal tension on the wire being strung, wire should be strung to a uniform, consistent, measured degree prior to attachment to fencing poles and splicing with other wire or tying-off at an end or corner of the fence being erected.

Prior art teaches methods and apparatus for tensioning wire. Known is the method of placing the wire behind a vehicle and then securing the wire and moving the vehicle until the wire is first strung a desired distance and then further moving the vehicle until the wire is "stretched" for splicing or tying-off at a second anchor point. This method does not provide for overly measurable tension on the wire prior to splicing or tying-off.

Also known are rope wire-stretchers whereby the wire is secured and strung and then one end of the stretcher is secured to an immovable object and the other end of the stretcher is attached to the wire. By means of a rope and pulley arrangement, the rope wire-stretcher stretches the wire for splicing or tying-off at a second anchor point. Tension provided by the rope wire-stretcher is generally limited to the amount of pull applied to the rope and pulley arrangement as well as the length of the rope wire-stretcher when fully extended. The tension on the wire is again not overly measurable by use of the rope wire-stretcher.

Also known is a ratchet and cable apparatus whereby a ratchet having a length of extendible cable is secured to an immovable object and the cable extended and secured to strung and secured wire. The ratchet is then worked to rewind the cable and thus "stretch" the wire for splicing or typing-off at a second anchor point. Again, the tension on the "stretched" wire is not overly measurable by use of a ratchet and cable apparatus.

Also known is a tensioning apparatus mounted on a carriage pulled by a tractor or other means, W. A. Maley, U.S. Pat. No. 3,201,085. Maley teaches a clamping frame mounted on a carriage, which clamping frame is pivotable in a clockwise/counter-clockwise direction, and a bar which is moved into clamping engagement with the wire to be "stretched". The clamping frame is pivoted in a counter-clockwise direction, secured to the wire, and pivoted in a clockwise direction, thereby moving the clamp secured to the wire and thus the wire tangentially along the fence line applying tension to the wire. Tension applied to the wire is controlled by a cylinder means providing pivotal movement to the clamping frame.

What is needed is a simple, safe, inexpensive and easily used apparatus which conveniently strings the wire strands over the terrain upon which the fence is to be erected as well as which tensions the wire strands to a uniform, consistent, measured degree for attachment to fencing poles.

SUMMARY OF THE INVENTION

The present invention differs from the prior art in that it provides for a simple, safe, inexpensive and easily used apparatus which conveniently strings the wire strands over the terrain upon which the fence is to be erected as well as which tensions the wire strands to a uniform, consistent, measured degree for attachment to fencing poles.

Accordingly, it is an object of the present invention to provide a simple, safe, inexpensive and easily used apparatus which conveniently strings the wire strands over the terrain upon which the fence is to be erected as well as which tensions the wire strands to a uniform, consistent, measured degree for attachment to fencing poles.

It is an additional object of the present invention to provide a simple, safe, inexpensive and easily used apparatus that eliminates the problems and disadvantages mentioned above and which conveniently strings the wire strands over the terrain upon which the fence is to be erected as well as which tensions the wire strands to a uniform, consistent, measured degree for attachment to fencing poles.

It is an additional object of the present invention to provide on a tractor supported frame a simple, safe, inexpensive and easily used apparatus which conveniently strings the wire strands over the terrain upon which the fence is to be erected as well as which tensions the wire strands to a uniform, consistent, measured degree for attachment to fencing poles.

These objects and others are accomplished by providing a wire fencing tensioning apparatus comprising a generally rectangular shaped open frame carriage mounted on a standard three-way hitch on the rear of a tractor. The generally rectangular shaped open frame carriage comprises a plurality of corresponding parallel members joined at ends to form corners, which members and corners define the generally rectangular shaped open frame carriage. The generally rectangular shaped open frame carriage has a long horizontal top member and a pair of long horizontal bottom members. A first long horizontal bottom member of the pair of long horizontal bottom members is attached to a second long horizontal bottom member of the pair of long horizontal bottom members by a pair of short horizontal bottom members. The first long horizontal bottom member of the pair of long horizontal bottom members is attached to the long horizontal top member by a pair of short vertical side members and a pair of short vertical support members.

The generally rectangular shaped open frame carriage has a pair of long vertical side members which are attached to the long horizontal top member by a pair of short horizontal top members and which are attached to the second long horizontal bottom member of the pair of long horizontal bottom members.

The long horizontal top member has a brace which attaches to the upper attachment member of a standard three-way hitch located on the rear of the tractor. The pair of short vertical support members each have an attachment brace which attaches to one of a pair of lower attachment members of a standard three-way hitch located on the rear of the tractor.

The wire fencing tensioning apparatus has a plurality of two extending hydraulic cylinders. The pair of extending hydraulic cylinders are supported vertically one each on one each of the pair of long vertical side members. The extending hydraulic cylinders are thus capable of extending vertically from the second long horizontal bottom member of the pair of long horizontal bottom members. Each of said extending hydraulic cylinders has a pulley attached to the top of the extending portion or piston thereof through each of which pulley a cable is strung.

The wire fencing tensioning apparatus has an hydraulic control means, said hydraulic control means being capable of independently controlling each of said extending hydraulic cylinders. The hydraulic control means is attached to a standard hydraulic system of the tractor to which the wire fencing tensioning apparatus is mounted by means of a pair of hydraulic fluid lines. The wire fencing tensioning apparatus has a pressure measurement gauge attached to a first hydraulic fluid line of the pair of hydraulic fluid lines, said pressure measurement gauge measuring the pressure of the hydraulic fluid in said first hydraulic fluid line.

The second long horizontal bottom member of the pair of long horizontal bottom members supports a pair of pulleys as well as spindles for the wire dispensing reels. The pair of pulleys on the second long horizontal bottom member are attached one each respectively to the ends of said second long horizontal bottom member, one pulley each attached external of the bottom of each of said extending hydraulic cylinders and the supporting pair of long vertical side members. The second long horizontal bottom member of the pair of long horizontal bottom members supports said spindles for the wire dispensing reels. The second long horizontal bottom member slidably receives a pair of extension members, one each of said pair of extension members being slidably received respectively in one each of the ends of said second long horizontal bottom member. Said extension members being secured in place within said ends of said second long horizontal bottom member by means of a pin of the spindle of the wire dispensing reels passing through corresponding holes through the extension members and the second long horizontal bottom member. Said pin-hole arrangement allowing for extension and securing of said extension members individually or both in the second long horizontal bottom member, which extension allows for placement of wire dispensing reels on either or both said extension members or said second long horizontal bottom member.

The wire fencing tensioning apparatus has a pair of pulley-cable systems by which tension is supplied to "stretch" the wire. The pair of pulley-cable systems provide one pulley-cable system each on one each of the pair of extending hydraulic cylinders. A first pulley-cable system of the pair of pulley-cable systems provides a first cable, which first cable is secured to the top of a first long vertical side member by a first end of said first cable. Said first cable runs over the top of the pulley located on the top of the extending portion or piston of the first extending hydraulic cylinder. The first cable then runs down the length of the extending hydraulic cylinder and under the pulley attached to the second long horizontal bottom member. The first cable then extends outwardly from the pulley attached to the second long horizontal bottom member in a direction parallel with the strung fence wire. A second end of said first cable has a wire clamp by which the fence wire is secured to said first cable.

A second pulley-cable system is identical to the first pulley-cable system and is located on the other end of the second long horizontal bottom member. A second cable is secured to the top of the second long vertical side member by a first end of said second cable and extends over the top of the pulley located on the top of the extending portion or piston of the second extending hydraulic cylinder. The second cable then runs down the length of the second extending hydraulic cylinder and under a pulley attached to the second long horizontal bottom member. The second cable then extends outwardly in a direction parallel with the strung fence wire. A second end of said second cable has a wire clamp by which the fence wire is secured to said second cable. The pair of pulley-cable systems provide for tensioning two separate strands of fence wire from opposite directions as well as tensioning single strands from either direction of the wire fencing tensioning apparatus.

Further objects and advantages of the present invention will become apparent as the description proceeds and when taken in conjunction with the accompanying drawings wherein:

DESCRIPTION OF THE PREFERRED EMBODIMENT

Reference now should be made to the drawings in which the same reference numbers are used throughout the various figures to designate the same components.

Figure 1:
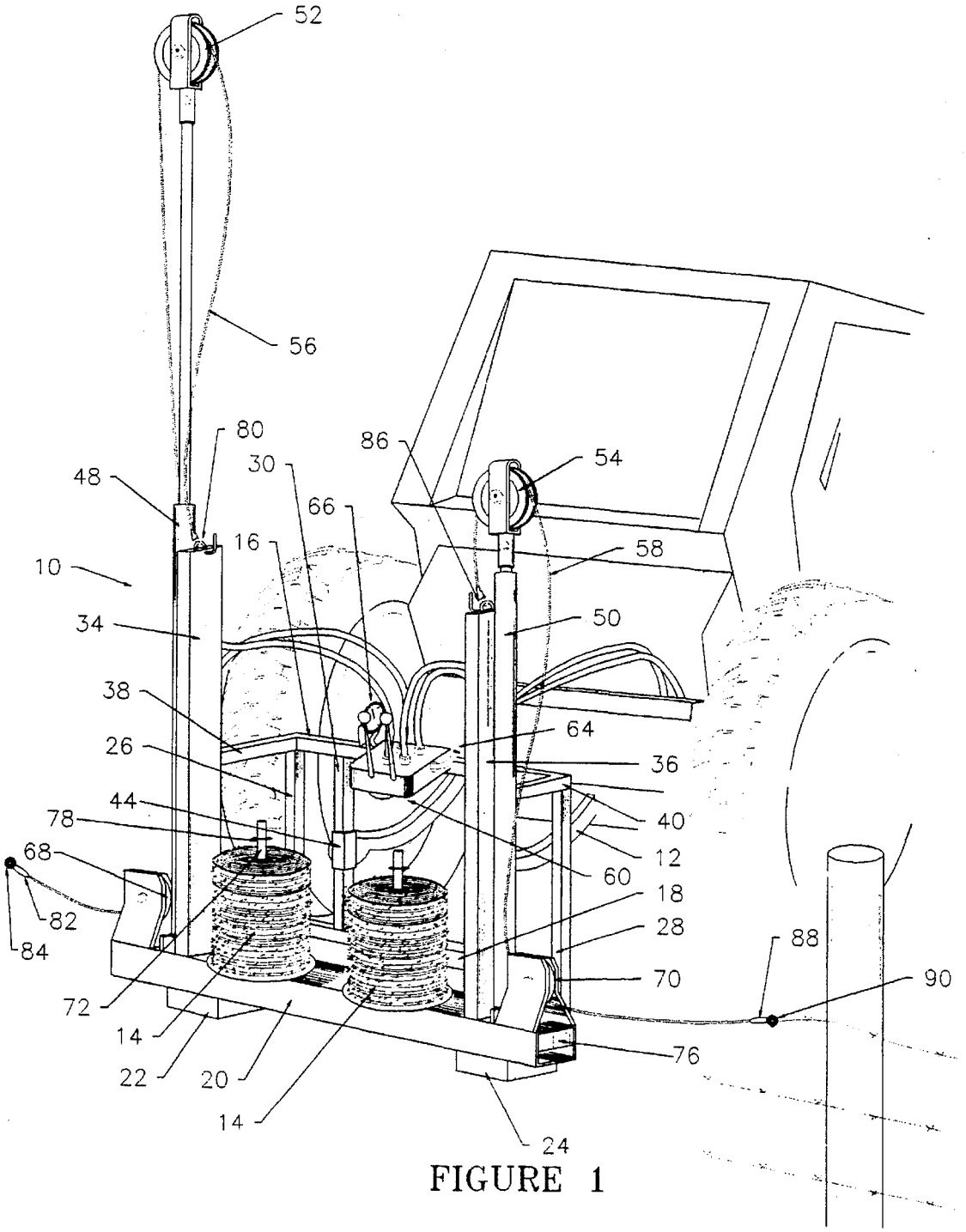
FIG. 1 is a perspective view showing the wire fencing tensioning apparatus attached to a tractor.
Figure 3:
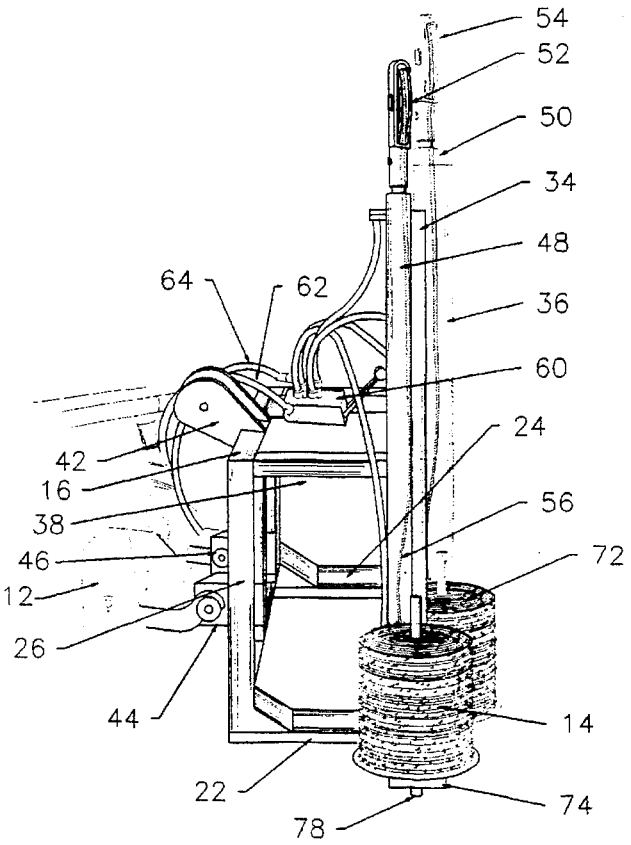
FIG. 3 is a side view showing the wire fencing tensioning apparatus attached to the tractor.

FIGS. 1 and 3 of the drawings shows the relative arrangement of a wire fencing tensioning apparatus 10 mounted on a standard three-way hitch 12 on the rear of a tractor. Shown is a wire fencing tensioning apparatus 10 comprising a generally rectangular shaped open frame carriage mounted on a standard three-way hitch 12 on the rear of a tractor. Also shown are a pair of wire dispensing reels 14 mounted on the generally rectangular shaped open frame carriage. The wire fencing tensioning apparatus 10 is mounted on a standard three-way hitch 12 on the rear of the tractor, which mounting provides for transport as well as vertical adjustment of the wire fencing tensioning apparatus 10 on the rear of the tractor relative to the ground surface. The tractor capably transports the wire fencing tensioning apparatus 10 over the various terrains being fenced while stringing fencing wire from the wire dispensing reels 14. The tractor further provides for a stable anchor when "stretching" the wire strands with the wire fencing tensioning apparatus 10.

Figure 2:
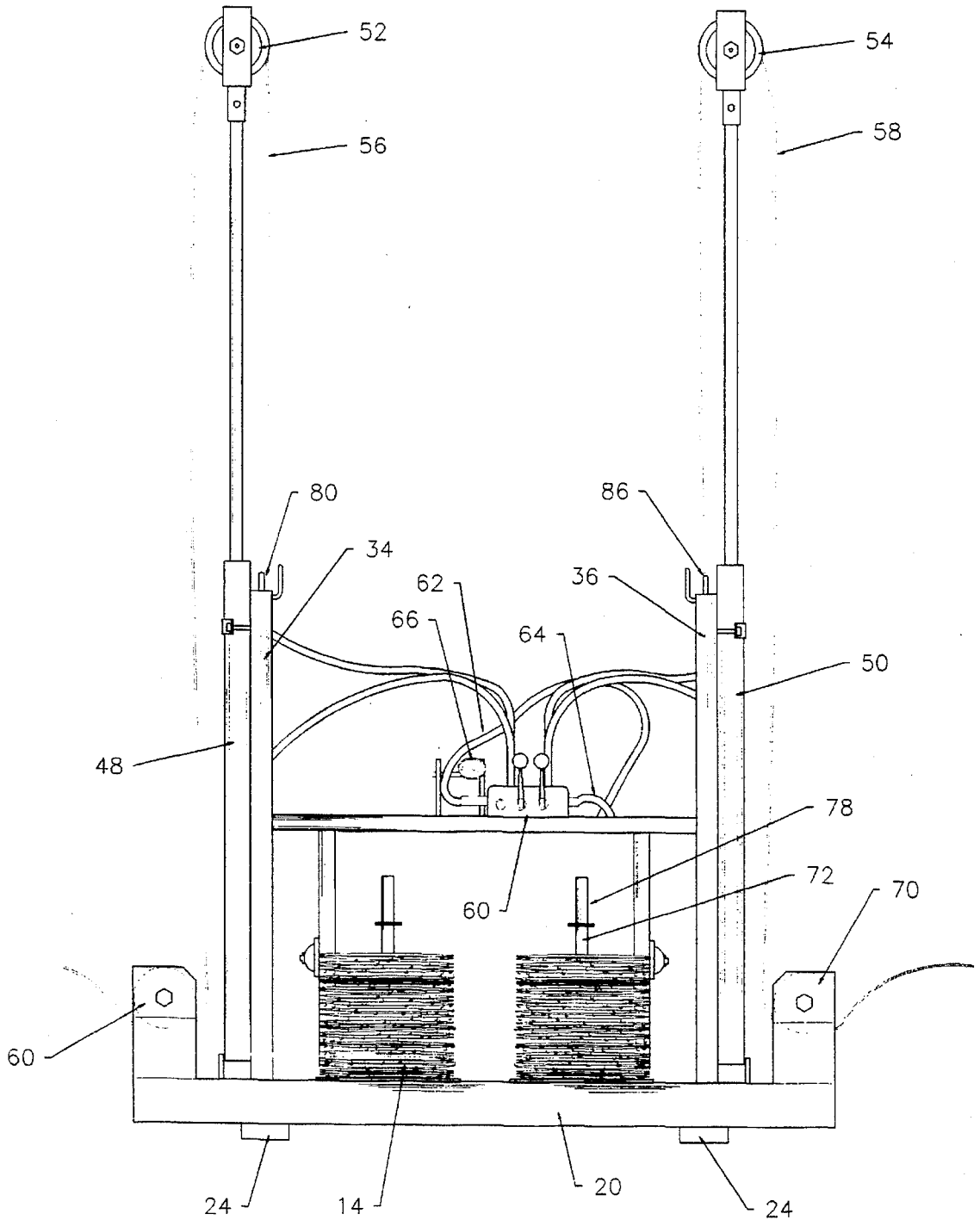
FIG. 2 is a rear view showing the wire fencing tensioning apparatus with the pair of extending hydraulic cylinders extended.

As shown in greater detail in FIG. 2, the generally rectangular shaped open frame carriage comprises a plurality of corresponding parallel members joined at ends to form corners, which members and corners define the generally rectangular shaped open frame carriage.

The generally rectangular shaped open frame carriage has a long horizontal top member 16 and a pair of long horizontal bottom members 18,20. A first long horizontal bottom member 18 of the pair of long horizontal bottom members 18,20 is attached to a second long horizontal bottom member 20 of the pair of long horizontal bottom members 18,20 by a pair of short horizontal bottom members 22,24. The first long horizontal bottom member 18 of the pair of long horizontal bottom members 18,20 is attached to the long horizontal top member 16 by a pair of short vertical side members 26,28 and a pair of short vertical support members 30,32.

The generally rectangular shaped open frame carriage has a pair of long vertical side members 34,36 which are attached to the long horizontal top member 16 by a pair of short horizontal top members 38,40 and which are attached to the second long horizontal bottom member 20 of the pair of long horizontal bottom members 18,20.

The long horizontal top member 16 has a brace 42 which attaches to the upper attachment member of a standard three-way hitch 12 located on the rear of the tractor. The pair of short vertical support members 30,32 each have an attachment brace 44,46 which attaches to one of a pair of lower attachment members of a standard three-way hitch 12 located on the rear of the tractor.

Figure 4:
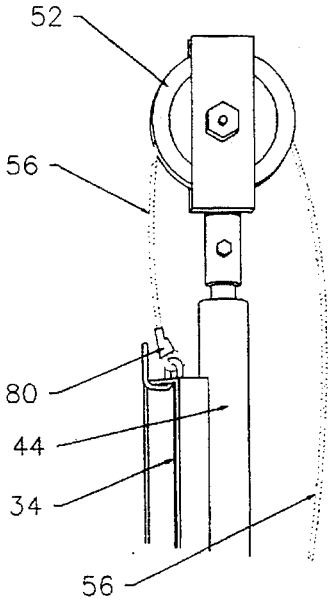
FIG. 4 is a view of a pulley and cable in the top of an extending hydraulic cylinder.

The wire fencing tensioning apparatus 10 has a pair of extending hydraulic cylinders 48,50. The pair of extending hydraulic cylinders 48,50 are supported vertically one each on one each of the pair of long vertical side members 34,36. The extending hydraulic cylinders 48,50 are thus capable of extending vertically from the second long horizontal bottom member 20 of the pair of long horizontal bottom members 18,20. As shown in FIG. 4, each of said extending hydraulic cylinders 48,50 has a pulley 52,54 attached to the top of the extending portion or piston thereof through each of which pulley 52,54 a cable 56,58 is strung as described hereinbelow.

The wire fencing tensioning apparatus 10 has an hydraulic control means 60, said hydraulic control means 60 being capable of independently controlling each of said extending hydraulic cylinders 48,50. The hydraulic control means 60 is attached to a standard hydraulic system of the tractor to which the wire fencing tensioning apparatus 10 is mounted by means of a pair of hydraulic fluid lines 62,64. The wire fencing tensioning apparatus 10 has a pressure measurement gauge 66 attached to a first hydraulic fluid line 62 of the pair of hydraulic fluid lines 62,64, said pressure measurement gauge 66 measuring the pressure of the hydraulic fluid in said first hydraulic fluid line 62.

Figure 5:
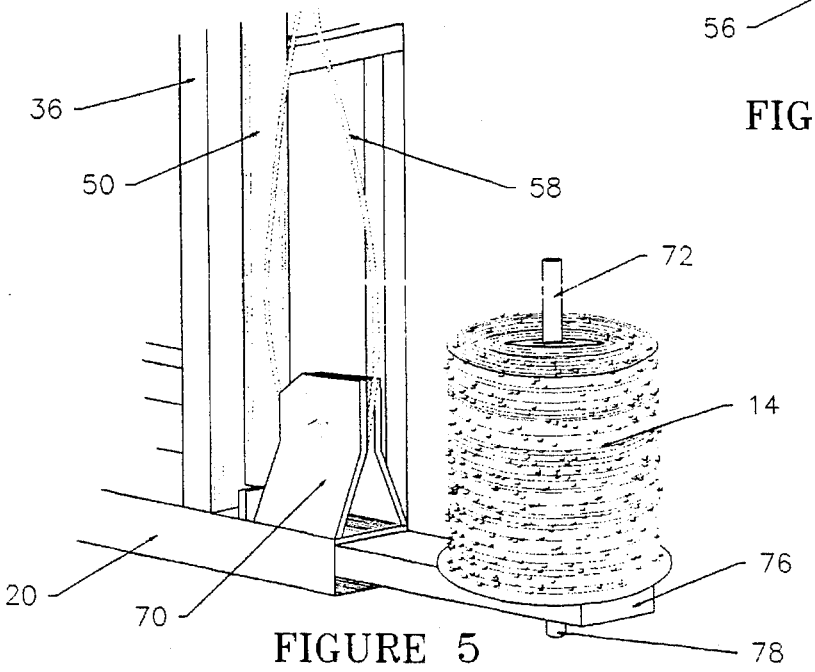
FIG. 5 is a view of pulley and cable on the second long horizontal bottom member and a wire dispensing reel and spindle on an extension member.

As shown in FIG. 5, the second long horizontal bottom member 20 of the pair of long horizontal bottom members 18,20 supports a pair of pulleys 68,70 as well as spindles 72 for the wire dispensing reels 14. The pair of pulleys 68,70 on the second long horizontal bottom meter 20 are attached one each respectively to the ends of said second long horizontal bottom member 20, one pulley each attached external of the bottom of each of said extending hydraulic cylinders 48,50 and the supporting pair of long vertical side members 34,36. The second long horizontal bottom member 20 of the pair of long horizontal bottom members 18,20 supports said spindles 72 for the wire dispensing reels 14. The second long horizontal bottom member 20 slidably receives a pair of extension members 74,76, one each of said pair of extension members 74,76 being slidably received respectively in one each of the ends of said second long horizontal bottom member 20. Said extension members 74,76 being secured in place within said ends of said second long horizontal bottom member 20 by means of a pin 78 of the spindle 72 of the wire dispensing reels 14 passing through corresponding holes through the extension members 74,76 and the second long horizontal bottom member 20. Said pin-hole arrangement allowing for extension and securing of said extension members 74,76 individually or both in the second long horizontal bottom member 20, which extension allows for placement of wire dispensing reels 14 on either or both said extension members 74,76 or said second long horizontal bottom member 20.

The wire fencing tensioning apparatus 10 has a pair of pulley-cable systems 52,56,68 and 54,58,70 by which tension is supplied to "stretch" the wire. The pair of pulley-cable systems 52,56,68 and 54,58,70 provide one pulley-cable system each on one each of the pair of extending hydraulic cylinders 48,50. A first pulley-cable system 52,56,68 of the pair of pulley-cable systems 52,56,68 and 54,58,70 provides a first cable 56, which first cable 56 is secured to the top of a first long vertical side member 34 by a first end 80 of said first cable 56. Said first cable 56 runs over the top of the pulley 52 located on the top of the extending portion or piston of the first extending hydraulic cylinder 48. The first cable 56 then runs down the length of the extending hydraulic cylinder 48 and under the pulley 68 attached to the second long horizontal bottom member 20. The first cable 56 then extends outwardly from the pulley 68 attached to the second long horizontal bottom member 20 in a direction parallel with the strung fence wire. A second end 82 of said first cable 56 has a wire clamp 84 by which the fence wire is secured to said first cable 56.

A second pulley-cable system 54,58,70 is identical to the first pulley-cable system 52,56,68 and is located on the other end of the second long horizontal bottom member 20. A second cable 58 is secured to the top of the second long vertical side member 36 by a first end 86 of said second cable 58 and extends over the top of the pulley located on the top of the extending portion or piston of the second extending hydraulic cylinder 20. The second cable 58 then runs down the length of the second extending hydraulic cylinder 50 and under a pulley 70 attached to the second long horizontal bottom member 20. The second cable 58 then extends outwardly in a direction parallel with the strung fence wire. A second end 88 of said second cable 58 has a wire clamp 90 by which the fence wire is secured to said second cable 58. The pair of pulley-cable systems 52,56,68 and 54,58,70 provide for tensioning two separate strands of fence wire from opposite directions as well as tensioning single strands from either direction of the wire fencing tensioning apparatus 10.

Generally, wire to be strung along a fence line is initially attached to a first anchor point in the fence line, such as a corner post or a gate post. As the tractor upon which the wire fencing tensioning apparatus 10 and wire dispensing reels 14 are mounted is driven on a route parallel to the fence line to be established or repaired, fencing wire is strung from the wire dispensing reels 14 to the terrain parallel to the fence line. After a desired length of wire is so strung, the tractor is stopped and the length of wire so strung severed from the wire fencing dispensing reel(s) 14. Once the wire is so severed, the tractor is positioned perpendicular to the strung wire such that the wire fencing tensioning apparatus 10 mounted to the rear of the tractor is adjacent to the severed end of the strung wire. The severed wire is attached to the wire fencing tensioning apparatus 10 and the wire is tensioned or "stretched". Once the appropriate tension has been imparted to the strung wire, the "stretched" wire is secured and the strung wire is attached to the fence posts establishing the fence line.

To tension or "stretch" the wire, the extending hydraulic cylinders 48,50 are reduced to their shortest vertical length and the first 56 and/or second cables 58 extended outwardly of the pulleys 68,70 attached to the second long horizontal bottom member 20. The wire clamps 84,90 on the second ends 82,88 of the outwardly extended first 56 and/or second cables 58 are secured to the severed end or ends of the strung fence wire, depending upon whether one or two strung wires are being tensioned or "stretched". The hydraulic control means 60 are manually activated causing an extending hydraulic cylinder 48,50 or both extending hydraulic cylinders 48,50 to extend vertically. Vertical extension of an extending hydraulic cylinder 48,50 or both extending hydraulic cylinders 48,50 in turn causes a pulley-cable system 52,56,68 or 54,58,70 or both pulley-cable systems 52,56,68 or 54,58,70 to shorten the length of the first 56 and/or second cable 58 extending outwardly of the pulleys 68,70 attached to the second long horizontal bottom member 20. Shortening the length of the first 56 and/or second cable 58 extending outwardly of the pulleys 68,70 attached to the second long horizontal bottom member 20 in turn pulls the strung fence wire in a direction toward the wire fencing tensioning apparatus 10 and thus providing tension on the strung fence wire in the direction towards the wire fencing tensioning apparatus 10 and effects a "stretching" of the fence wire towards the wire fencing tensioning apparatus 10. The amount of tension on the "stretched" fence wire is measured by the pressure measurement gauge 66 measuring the pressure of the hydraulic fluid in the hydraulic fluid line 62 to the hydraulic control means 60. The hydraulic control means 60 are positioned on the wire fencing tensioning apparatus 10 so the operator faces the rear of the tractor and has safe, easy access to the hydraulic control means 60 from the rear opening of the generally rectangular shaped open frame carriage.

While one embodiment of the invention has been shown and described, it will be apparent that other adaptations and modifications may be made without departing from the scope of the following claims.

What is claimed and desired to be secured by United States Letters Patent is:

1. A wire fencing tensioning apparatus for use with a tractor having a standard three-way hitch and a hydraulic system, said wire fencing tensioning apparatus comprising:

a generally rectangular shaped open frame carriage for attachment to the standard three-way hitch;

said generally rectangular shaped open frame carriage having a plurality of corresponding parallel members joined at ends to form corners, which members and corners define the generally rectangular shaped open frame carriage;

said generally rectangular shaped open frame carriage having a long horizontal top member and a pair of long horizontal bottom members;

a first long horizontal bottom member of the pair of long horizontal bottom members being attached to a second long horizontal bottom member of the pair of long horizontal bottom members by a pair of short horizontal bottom members;

said first long horizontal bottom member of the pair of long horizontal bottom members being attached to said long horizontal top member by a pair of short vertical side members and a pair of short vertical support members;

said generally rectangular shaped open frame carriage having a pair of long vertical side members, said pair of long vertical side members being attached to said long horizontal top member by a pair of short horizontal top members;

said pair of long vertical side members being attached to said second long horizontal bottom member of the pair of long horizontal bottom members;

said long horizontal top member having an attachment brace, said attachment brace attaching to an upper attachment member of the standard three-way hitch;

said pair of short vertical support members each having an attachment brace, said attachment braces attaching one each to each of a pair of lower attachment members of the standard three-way hitch;

said pair of long vertical side members each supporting one each of a pair of extending hydraulic cylinders, said pair of extending hydraulic cylinders adapted to extend vertically from said second long horizontal bottom member of the pair of long horizontal bottom members;

said pair of extending hydraulic cylinders each having a pulley attached to a top of an extending portion or a piston thereof;

a pair of hydraulic control means, said hydraulic control means one each controlling one each of said extending hydraulic cylinders;

said pair of hydraulic control means being attached to the hydraulic system of the tractor;

a pressure measurement gauge being attached to a common hydraulic fluid line between the hydraulic system of the tractor and said pair of hydraulic control means, said pressure measurement gauge measuring the pressure of hydraulic fluid in said common hydraulic fluid line;

said second long horizontal bottom member of the pair of long horizontal bottom members supporting a pair of pulleys as well as at least one spindle for wire dispensing;

said pair of pulleys on said second long horizontal bottom member being attached one each to a first end and a second end of said second long horizontal bottom member, said first end and said second end of said second long horizontal bottom member being external of each of said extending hydraulic cylinders and said pair of long vertical side members;

a pair of pulley-cable systems, said pair of pulley-cable systems supplying tension to the wire;

said pair of pulley-cable systems being provided one each on each of said extending hydraulic cylinders and the corresponding long vertical side member to which one each of said extending hydraulic cylinders is attached;

a first pulley-cable system of the pair of pulley-cable systems having a first cable secured to a top of a first long vertical side member by a first end of said first cable;

said first cable running over said pulley located on the top of the extending portion or piston of said first extending hydraulic cylinder, down the length of said first extending hydraulic cylinder and under a first pulley attached to said second long horizontal bottom member, said first cable then extending outwardly from the first pulley in a direction parallel with a strung fence wire;

a second end of said first cable having a wire clamp for securing the strung fence wire to said first cable;

a second pulley-cable system of the pair of pulley-cable systems having a second cable secured to a top of a second long vertical side member by a first end of said second cable;

said second cable running over said pulley located on the top of the extending portion or piston of said second extending hydraulic cylinder, down the length of said second extending hydraulic cylinder and under a second pulley attached to said second long horizontal bottom member, said second cable then extending outwardly from the second pulley in a direction parallel with the strung fence wire but opposite said direction of said first cable;

a second end of said second cable having a wire clamp for securing the strung fence wire to said second cable;

said pair of pulley-cable systems providing for tensioning of two separate strands of strung fence wire from opposite directions as well as tensioning single strands of strung fence wire from either direction of the wire fencing tensioning apparatus.

* * * * *